United States Patent [19]

Busse

[11] 4,185,357

[45] Jan. 29, 1980

[54] FURNITURE HINGE COMPONENT

[75] Inventor: Peter Busse, Vlotho, Fed. Rep. of Germany

[73] Assignee: Richard Heinze Co., Herford, Fed. Rep. of Germany

[21] Appl. No.: 892,952

[22] Filed: Apr. 3, 1978

[30] Foreign Application Priority Data

May 26, 1977 [DE] Fed. Rep. of Germany ..... 2723850

[51] Int. Cl.[2] ..... E05D 7/04

[52] U.S. Cl. ..... 16/130; 16/131; 16/132

[58] Field of Search ..... 16/129, 130, 131, 132, 16/133, 134

[56] References Cited

FOREIGN PATENT DOCUMENTS

| | | | |
|---|---|---|---|
| 2432158 | 1/1976 | Fed. Rep. of Germany | 16/131 |
| 2439252 | 4/1976 | Fed. Rep. of Germany | 16/129 |
| 2542462 | 3/1977 | Fed. Rep. of Germany | 16/129 |
| 2554129 | 6/1977 | Fed. Rep. of Germany | 16/129 |
| 2554133 | 6/1977 | Fed. Rep. of Germany | 16/129 |

*Primary Examiner*—George H. Krizmanich
*Attorney, Agent, or Firm*—Geoffrey L. Chase; Martin P. Hoffman

[57] ABSTRACT

A hinge component for pivotally connecting two parts of a piece of furniture includes a fastener member adapted to be attached to one part of the furniture, a carrier member mounted in the fastener member for adjustable displacement relative thereto along a first axis, and a hinge arm member which carries a hinge shaft defining the pivotal axis of the hinge component. The hinge arm member is mounted in a guide groove formed in the carrier member for adjustable displacement relative thereto along a second axis perpendicular to the first axis. After the carrier member is adjusted relative to the fastener member, and the hinge arm member is adjusted relative to the carrier member, the hinge arm member can be clamped between the carrier and fastener members. Thereafter, the hinge arm member can be adjustably displaced relative to both the fastener and carrier members along a third axis perpendicular to both the first and second axis thus providing three degrees of freedom for the hinge shaft.

18 Claims, 15 Drawing Figures

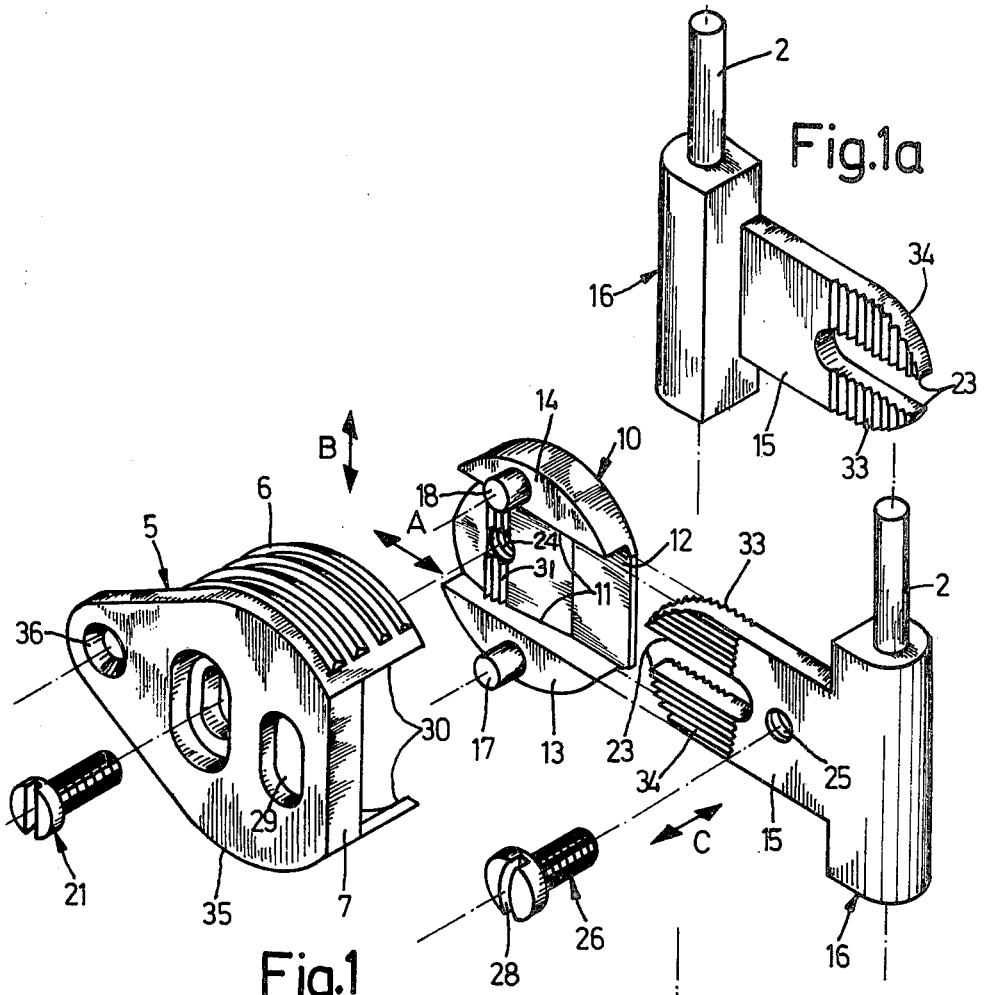
Fig.1a
Fig.1
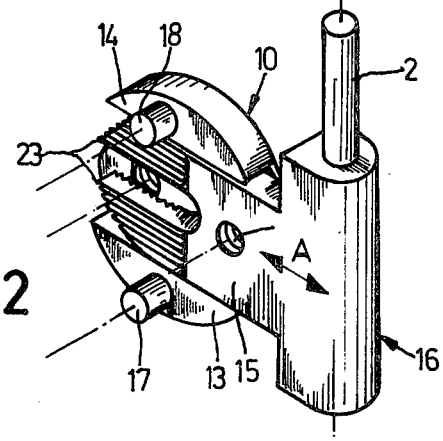
Fig.2

(III-III)

(II-II)

(I-I)

(VI-VI)

(V-V)

(IV-IV)

FURNITURE HINGE COMPONENT

BACKGROUND OF THE INVENTION

This invention relates to a furniture hinge for pivotally connecting two parts of a piece of furniture, and more particularly to a hinge for pivoting a door to the frame of a piece of furniture.

A conventional furniture hinge comprises a first hinge component mounted on one part of a piece of furniture, a second hinge component mounted on the other part of the piece of furniture, and a pivotal connection between the components for effecting pivotal movement of one part of the piece of furniture relative to the other. A known type of hinge component includes a cup-shaped fastener member anchored in a counter-sunk bore in a surface of one of the parts of the piece of furniture, and a hinge arm that is adjustably seated in the cup-shaped fastener for permitting limited adjustment to the hinge arm member which carries a hinge shaft that defines the pivotal axis of the hinge. Despite its relative complex design, such a hinge component permits the hinge arm member to be adjusted along only a single axis that is transverse and perpendicular to the axis of the pivot shaft. Manufacturers of contemporary furniture, however, have increasing need for hinges that also permit the hinge arm member to be adjusted along an axis parallel to the axis of the hinge shaft. Ideally, the hinge arm member should be adjustable along three mutually perpendicular axes, namely, along an axis perpendicular and parallel to the surface of one of the parts of the piece of furniture, and along axes perpendicular and parallel to the axis of the hinge shaft.

SUMMARY OF INVENTION

A hinge component according to the present invention comprises a fastener member adapted to be attached to one part of a piece of furniture; a carrier member mounted in a cavity within the fastener member for adjustable displacement along a first axis; and a hinge arm member which carries a hinge shaft defining the pivotal axis of the hinge component. The hinge army member is mounted in a guide groove formed in the carrier member for adjustable displacement relative thereto along a second axis perpendicular to the first axis. The hinge member is releasably clamped between the carrier member and the fastener member by a fastener passing between the two last mentioned members. Thereafter, the hinge arm member can be adjustably displaced relative to both the fastener and the carrier member along a third axis perpendicular to both the first and second axes by utilizing an adjustment screw engaging the hinge arm member and the fastener member. As a consequence of this construction, the hinge shaft carried by the hinge arm member can be adjusted along three mutually perpendicular axes.

The carrier member preferably comprises a disc-like plate provided on one surface with the guide groove which receives a tongue on the hinge arm member. The guide groove, at least in the vicinity of the portion receiving the fastener, is shallower than the tongue and faces a wall segment of the fastener member which is cup-like in construction. A single threaded fastener passing through the wall segment and threaded into the carrier member will clamp the tongue of the hinge arm member between the carrier member and the fastener member to define a hinge component according to the present invention which is particularly simple in design and economical in construction yet will provide the required degrees of adjustment for the hinge shaft of the component.

BRIEF DESCRIPTION OF THE DRAWINGS

An embodiment of the invention is described below in connection with the accompanying drawings wherein:

FIG. 1 is an exploded perspective view of a hinge component according to the present invention including a fastener member adapted to be attached to a side wall of a piece of furniture, a carrier member, and a hinge arm member carrying a hinge shaft defining the pivotal axis of the hinge component;

FIG. 1A is a perspective view of the hinge arm member of FIG. 1 but in a position rotated about 180° about the axis of the hinge shaft;

FIG. 2 is a perspective view of the hinge arm member mounted on the carrier member;

DESCRIPTION OF PREFERRED EMBODIMENT

Figure 5:
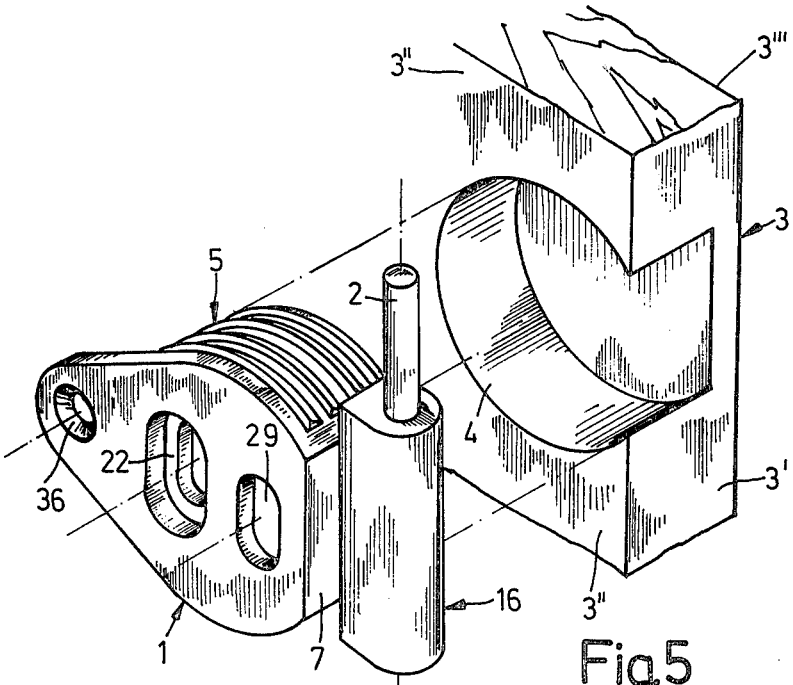
FIG. 5 is a perspective view of a completely assembled hinge component according to the present invention prior to mounting of the same into a side wall of the piece of furniture provided with a counter-sunk bore for receiving the fastener member.
Figure 6:
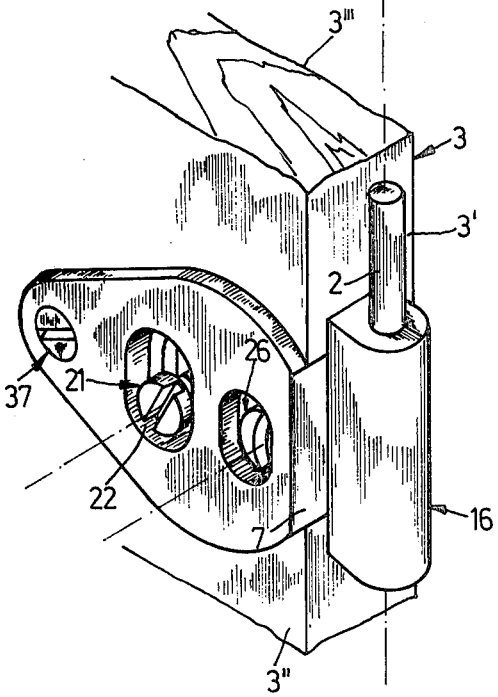
FIG. 6 is a view similar to FIG. 5 but showing the hinge component mounted on the piece of furniture.
Figure 7:
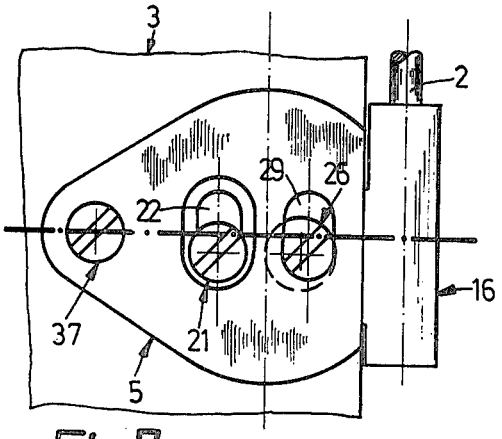
FIG. 7 is a front view of the hinge component mounted on a piece of furniture.

Referring first to FIGS. 5 and 6, reference numeral 1 designates a hinge component according to the present invention mounted in side wall 3 of a piece of furniture. Component 1 comprises a single hinge shaft 2 that is spaced from edge 3' of wall 3 which contains counter-sunk bore 4 that opens into edge 3'. Barb-like ribs 6 formed on the outer periphery of the cup-shaped portion of fastener member 5 anchor the component in bore 4 such that flat segment 7 on member 5 is flush with edge 3' of side wall 3 of the piece of furniture.

Figure 3:
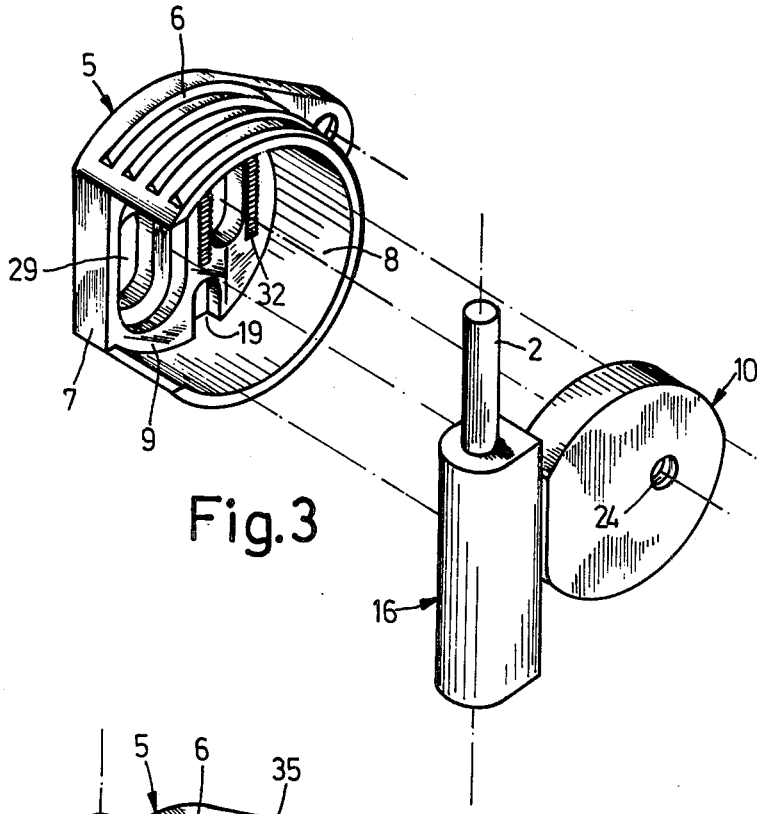
FIG. 3 is a rear, perspective view of the fastener member showing its cup-like construction, and a preassembly consisting of the hinge arm member preassembled on the carrier member prior to insertion of the preassembly into the fastener member.
Figure 4:
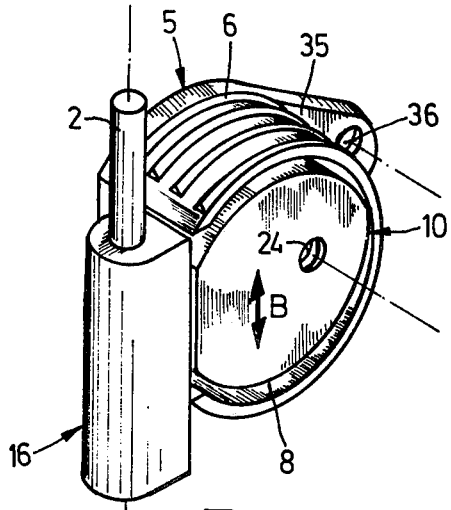
FIG. 4 is similar in FIG. 3 except the preassembly is shown inserted into the fastener member.

As shown in FIG. 3, fastener member 5 includes wall segment 9 defining the bottom of the cup-shaped member and an interrupted cylindrical wall perpendicular to segment 9. Cavity 8 is closed after member 5 is seated in bore 4 (see FIG. 6). Support member 10 is disc-shaped and fits into cavity 8. One surface of member 10 is provided with lengthwise guide groove 11 (FIG. 1) extending from edge-to-edge, the groove having a generally U-shaped cross-section with a bottom surface that includes support face 12 adjacent one edge. Sides 13 and 14 defining the groove are formed by two wall segments that extend in a lengthwise direction, i.e., in the direction of double arrow A. The width of groove 11 corresponds to the width of tongue 15 on hinge arm member 16 carrying hinge shaft 2 whose axis defines the pivotal axis of the hinge component. Tongue 15 is thicker than the depth of at least a part of groove 11 and is slidably received therein for movement in the direction of double arrow A (see FIG. 1).

Figure 10:
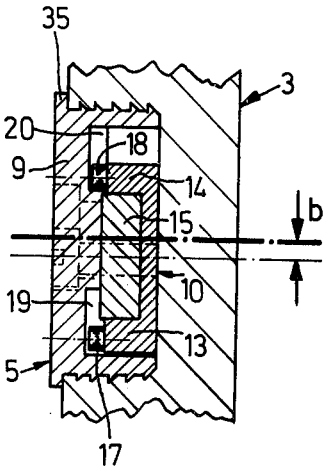
FIG. 10 is a section taken along the line III—III of FIG. 9.

As shown in FIG. 1, guide pins 17 and 18 on faces 13 and 14 of carrier member 10 face wall segment 9 of fastener member 5, and seat in guide slots 19 and 20 (see FIG. 10) located on the inside of wall segment 9 when carrier member 10 is nested in cavity 8 of member 5. Slots 19 and 20 extend in a direction parallel to the direction of hinge shaft 2 when the members are assembled into the component, that is, in the direction of double arrow B (FIG. 1). Guide pin 17 and 18, together with guide slots 19 and 20 permit adjustment of the carrier member 10 on fastener member 5 in the direction of double arrow B.

A single screw 21 is used to attach hinge arm member 16 to both carrier member 10 and fastener member 5. Screw 21 passes through slotted hole 22 (FIGS. 5 and 6) in wall segment 9 and through clearance slot 23 of tongue 15 to engage threaded hole 24 in the bottom surface of guide groove 11, i.e., in the adjacent support face 12 of the carrier member. Because the depth of groove 11 in the region adjacent hole 24 is less than the thickness of tongue 15, hinge arm member 16 will be clamped between the bottom surface of guide groove 11 and the inside of wall segment 9 of fastener member 5 when screw 21 is threaded into hole 24.

Figure 8:
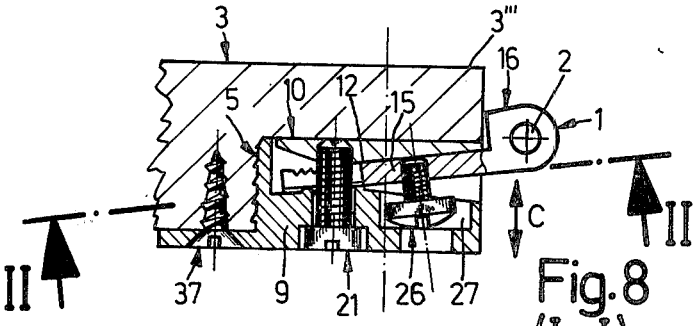
FIG. 8 is a section along the line I—I of FIG. 9.
Figure 11:
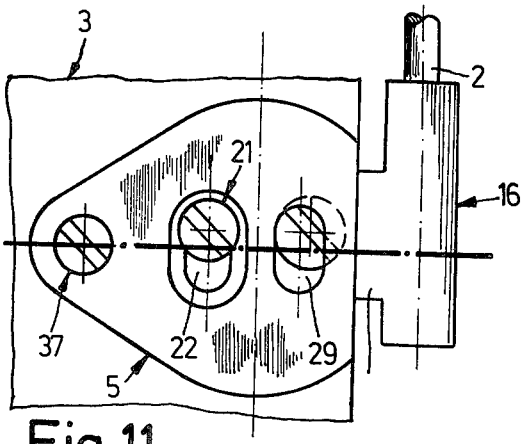
FIG. 11 is similar to FIG. 7 but shows another position of the hinge arm member of the fastener member.
Figure 14:
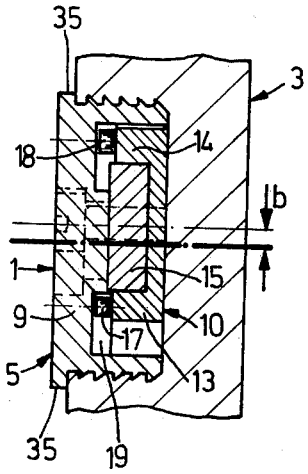
FIG. 14 is a section taken along the line VI—VI of FIG. 13.
Figure 13:
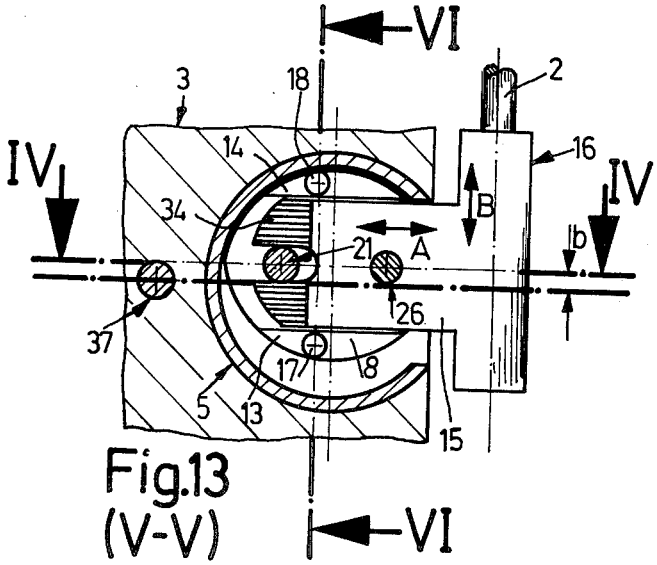
FIG. 13 is a section taken along the line V—V of FIG. 12.
Figure 12:
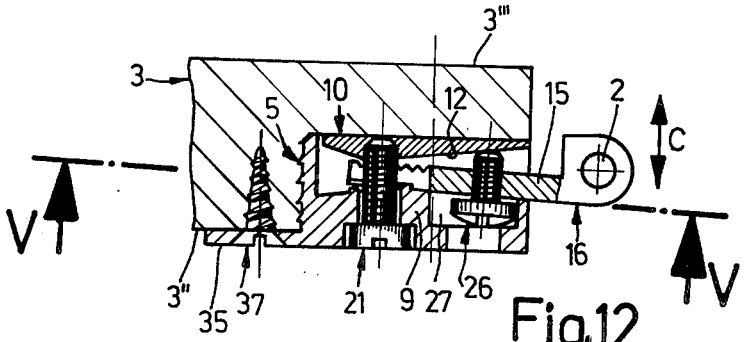
FIG. 12 is a section taken along the line IV—IV of FIG. 13.

In order to adjust hinge shaft 2 in a direction perpendicular to wall segment 9, i.e., in the direction of double arrow C (see FIG. 1), and perpendicular to the directions of double arrows A and B, a threaded hole 25 is provided in tongue 15 for receiving adjustment screw 26 whose head is received in recess 27 (see FIGS. 8 and 12) on the inner surface of wall segment 9 of fastener member 5. Slot 29 in wall segment 9 is elongated in the direction of double arrow B and opens into recess 27 to provide clearance for a tool, such as a screw driver, to pass through wall 9 into recess 27 and engage slot 28 in the head of adjustment screw 26 when the latter is threaded into hole 25. Recess 27 is large enough in the directions of double arrows A and B to permit clearance for the head of screw 26 as the hinge arm member 16 is moved in the direction of double arrow A relative to carrier member 10 and as the assembly of hinge arm member 16 and carrier member 10 is moved in the direction of double arrow B relative to fastener member 5. Face 12 associated with groove 11 in member 10 is inclined as indicated in FIGS. 8 and 12 to provide clearance for pivotal movement of tongue 15 about an axis parallel to double arrow B and passing through screw 21. Such movement occurs in response to rotation of screw 26 which moves hinge shaft 2 along the axis designated by double arrow C. The direction of movement depends on direction of rotation of screw 26 relative to threaded hole 25.

In assembling the members of hinge component 1, carrier member 10 is first nested in cavity 8 of fastener member 5 by seating pins 17 and 18 in guide slots 19 and 20 on wall surface 9. Then, screw 21 is partially threaded into hole 24 thereby loosely holding members 5 and 10 together with interruption 30 of the cylindrical wall of member 5 (FIG. 1) aligned with slot 11 in member 10. Tongue 15 of hinge arm member 16, into which screw 26 has been preassembled, is inserted through interruption 30 into sliding engagement with groove 11, slot 23 in the tongue providing clearance for screw 21. Insertion of tongue 15 continues until the slotted head of screw 26 is contained within recess 27 in wall segment 9. After this occurs, screw 21 can be threaded further into hole 24 until adjustment screw 26 is captured in the recess thereby retaining the hinge arm member to both the fastener member and carrier member.

Having preassembled the members, hinge component 1 can be attached to the piece of furniture by forcing fastener member 5 into bore 4 in side wall 3 of the furniture. Even though screw 21 is not as yet fully tightened, the hinge component will be able to absorb the weight of a door when it is attached to the hinge component because of the reaction between tongue 15 and groove 11 which limits relative movement of the hinge arm in the direction of double arrow A and the reaction of pins 17 and 18 in slots 19 and 20 which limit movement of members 10 and 16 in the direction of double arrow B. Before screw 21 is fully tightened into hole 24, hinge shaft 2 can be adjusted to compensate for dimensional tolerances along the three coordinate axes denoted by the double arrows A, B and C. That is to say, the axis of hinge shaft 2 can be moved in the direction of double arrow A, i.e., in a direction parallel to surface 3″ of the furniture and perpendicular to end face 3′, in the direction of double arrow B (i.e., in a direction parallel to surface 3″ and parallel to end face 3′), and also in the direction of double arrow C (i.e., in a direction parallel to end face 3′ and perpendicular to surface 3″).

When the axis of hinge shaft 2 is properly located, screw 21 is fully tightened thus clamping tongue 15 of hinge arm member 16 between carrier 10 and the inside surface of wall segment 9 of fastener member 5. To assist in holding hinge arm member 16 in its selected position, the inner surface of wall segment 9 adjacent elongated slot 22 through which screw 21 passes is provided with serrations 32 (see FIG. 3). In addition, the portion of the bottom surface of groove 11 in the vicinity of threaded aperture 24 is serrated at 31 (see FIG. 1); and the opposite surfaces of tongue 15 in the vicinity of clearance slot 23 are serrated as shown at 33 and 34. Both serrations 32 and serrations 34, which engage each other, extend in the direction of double arrow A; and serrations 31 which mate with serrations 33, extend in the direction of arrow B.

The length of adjustment screw 26 is chosen to fit entirely within recess 27 and surface 12 as shown in FIGS. 8 and 12. Consequently, the slotted head of screw 26 will seat against the inside surface of recess 27 while the free threaded end of the screw will seat surface 12. After screw 26 is rotated until shaft 2 is in the selected position, further tightening of screw 21 will preclude further rotation of screw 26 thus ensuring stability in the selected attitude of hinge arm shaft 2. Thus, in the hinge component of the present invention, only a single screw is used to interlock all of the members.

Figure 9:
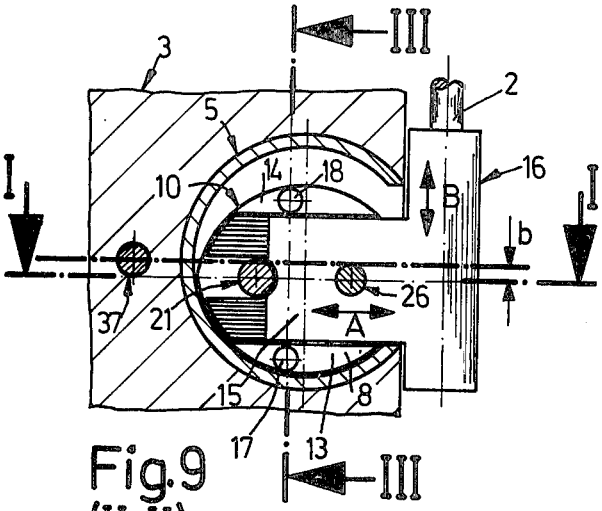
FIG. 9 is a section taken along the line II—II of FIG. 8.

As shown in FIGS. 7–14, the hinge component of the present invention permits a considerable displacement of hinge shaft 2 along three mutually perpendicular axes corresponding to double arrows A, B and C. The position of the axis of hinge arm 2 relative to end face 3' of the furniture can be minimized in the manner shown in FIGS. 7–9, by sliding tongue 15 inwardly relative to carrier member 10 as far as possible and by tilting the hinge arm member until it contacts support surface 12 of member 10 as shown in FIG. 8. In this position, the hinge shaft 2 can be moved in the direction of double arrow B by sliding member 10 through the displacement b as indicated in FIG. 9.

FIGS. 11–14 show a setting of hinge arm members 16 by which the hinge is shifted by a maximum amount b in the direction of double arrow B while the hinge shaft 2 is positioned at a maximum distance from end face 3' and from outer surface 3''' of the side wall three of the piece of furniture. The range of adjustment of hinge arm 16 and consequently the adjustment of hinge shaft 2 is enhanced by inclining the inside of surface of wall segment 9 from the region of slot 22 where the thickness of the wall section is a maximum as shown in FIGS. 8 and 12. In addition, the support surfaces of carrier member 10 facing the inside surface of wall segment 9 are likewise inclined as shown in FIGS. 8 and 12 thereby permitting maximum displacement of hinge arm member 16 about an axis passing perpendicularly through screw 21 in a direction parallel to the double arrow B.

In order to limit the depth of penetration of fastener member 5 into the seating bore 4, the member 15 provided with projecting flange 35 (FIG. 1) on the surface of wall segment 9 that is exposed when the fastener is mounted in the side wall piece of furniture. Such flange rests against the inside surface 3'' of the side wall 3' of the piece of furniture surrounding bore 4. Flange 35 narrows into a triangular tang containing hole 36 through which an additional anchoring screw 37 can be inserted as shown in FIGS. 8 and 12.

The material for hinge arm member 16 and fastener member 5 is preferably metal. However, a tough plastic can be used to make members 5 and 10.

It is believed that the advantages and improved results furnished by the apparatus of the present invention are apparent from the foregoing description of the several embodiments of the invention. Various changes and modifications may be made without departing from the spirit and scope of the invention as sought to be defined in the claims that follow.

I claim:

1. In a furniture hinge for pivotally connecting two parts of a piece of furniture, and in particular a door to a body of a piece of furniture, a first hinge component mounted on one part of the piece of furniture and having at least one pivot, which connects the first hinge component in an articulating manner with a second hinge component mounted on the other part of furniture, the first hinge component including a fastener member anchored in a bore hole in a surface of one of the parts of the piece of furniture and a hinge arm member adjustably secured to the fastener member and carrying at least one hinge shaft defining said pivot, the improvement comprising:

a first hinge component having a carrier member having guide means on said carrier member and guide means consisting of a wall segment on the fastener member of said first hinge component for displaceably mounting said carrier member on said fastener member so as to be movable relative to said fastener along a first axis parallel to said hinge shaft, and for displaceably mounting said hinge arm member on the carrier member so as to be movable relative to said carrier member along a second axis perpendicular to the first; and means for clamping the carrier member to the fastener member and for clamping the hinge arm member to the carrier member.

2. The invention of claim 1 wherein said guide means by which the hinge arm member can be displaced relative thereto along a second axis perpendicular to the first comprise a support face on the carrier member and a wall segment on the fastener member, said wall segment facing said carrier member, and wherein said hinge arm or tongue of said hinge arm member extends between said wall segment and said support face for effecting relative displacement between the hinge arm member and the carrier member along the second axis.

3. The invention of claim 2 wherein the wall segment is formed to at least partly close off the end face of the fastener member, which end face is visible when the fastener member is anchored in the bore hole in the surface of the one of the parts of the piece of furniture.

4. The invention of claim 2 wherein guide slots are provided on the surface of the wall segment facing the support face, and guide pins are provided on the carrier member cooperable with the guide slots for effecting relative displacement between the carrier member and the fastener member along the first axis.

5. The invention of claim 2 wherein the guide means of the carrier member is a U-shaped guide groove extending in the direction of the second axis and is defined by a pair of sides and the support surface of the carrier member by which the tongue is slidably received for prevent rotation of the hinge arm member about a third axis perpendicular to the first and second axes.

6. The invention of claim 5 wherein the sides of the carrier member extend perpendicularly to the wall segment of the fastener member.

7. The invention of claim 6 wherein said support face on the carrier member interconnects the pair of sides which define the U-shaped guide groove of the carrier member.

8. The invention of claim 5 wherein the tongue on the hinge arm member is thicker than the depth of the guide groove at least in a portion thereof.

9. The invention of claim 8 wherein a support surface on the carrier member connecting the pair of sides is inclined relative to the direction of the second axis.

10. The invention of claim 4 wherein the guide slots on the surface of the wall segment are in the form of parallel guide slots extending in the direction of the first axis and the guide pins on the carrier member cooperable with the guide slots are in the form of cylindrical guide pins that seat in the slots.

11. The invention of claim 1 wherein the hinge arm member projects through an interruption in the fastener member and extends beyond the periphery of the latter.

12. The invention of claim 2 including means for clamping consisting of a screw passing through an elongated slot in the tongue of the hinge arm member, the slot extending in the direction of the first axis, and said screw threaded into a threaded hole of the carrier member.

13. The invention of claim 7 including means for adjusting the hinge arm member along a third axis perpendicular to both the first and second axes, such means including a threaded bolt whose length is such as to fit between the wall segment and the carrier member.

14. The invention of claim 13 wherein one of the ends of the threaded bolt has a head that projects into a clearance in the wall segment, the dimensions of such clearance in the direction of the second axis being larger than the diameter of the head to permit displacement of the hinge arm member along the second axes.

15. The invention of claim 14 wherein the length of the threaded bolt is such that one end of the bolt abuts the carrier member and the other end abuts the wall segment of the fastener member when the hinge arm member is clamped between the carrier and fastener members.

16. The invention of claim 15 wherein first cooperating serrated means are provided on the wall segment of the fastener member and on the surface of the tongue on the hinge arm member which faces the wall segment, and a second cooperating serrated means are provided on the carrier member and on the surface of the tongue which faces the carrier member.

17. The invention of claim 1 wherein the fastener member and/or carrier member is made of plastic.

18. The invention of claim 17 wherein the hinge arm member is made of metal.

* * * * *